US008365536B2

(12) United States Patent
Khan et al.

(10) Patent No.: US 8,365,536 B2
(45) Date of Patent: Feb. 5, 2013

(54) DUAL FUEL COMBUSTOR NOZZLE FOR A TURBOMACHINE

(75) Inventors: Abdul Rafey Khan, Greenville, SC (US); Christian Xavier Stevenson, Inman, SC (US); Baifang Zuo, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 362 days.

(21) Appl. No.: 12/563,491

(22) Filed: Sep. 21, 2009

(65) Prior Publication Data

US 2011/0067379 A1 Mar. 24, 2011

(51) Int. Cl.
*F02C 1/00* (2006.01)

(52) U.S. Cl. ..... 60/742; 60/39.463

(58) Field of Classification Search ..... 60/737, 60/738, 740, 742, 746, 748, 39.463; 239/132.3, 239/132.5, 403–405
See application file for complete search history.

(56) References Cited

U.S. PATENT DOCUMENTS 3,691,765 A * 9/1972 Carlisle ..... 60/742
4,105,163 A * 8/1978 Davis et al. ..... 239/406
4,417,439 A 11/1983 Sepulveda et al.
4,548,032 A 10/1985 Sepulveda et al.
4,708,293 A * 11/1987 Graziadio et al. ..... 239/427
4,890,793 A * 1/1990 Fuglistaller et al. ..... 239/427
5,222,357 A 6/1993 Eddy et al.
5,359,847 A 11/1994 Pillsbury et al.
5,361,578 A 11/1994 Donlan
5,408,825 A 4/1995 Foss et al.
5,657,632 A 8/1997 Foss
5,833,141 A 11/1998 Bechtel, II et al.
5,873,237 A 2/1999 Medla et al.
6,123,273 A 9/2000 Loprinzo et al.
6,363,724 B1 4/2002 Bechtel et al.
6,385,960 B1 5/2002 Kress et al.
6,434,945 B1 8/2002 Mandai et al.
6,453,673 B1 9/2002 Bechtel et al.
6,460,326 B2 10/2002 Bechtel et al.
6,609,378 B2 8/2003 Scott
7,108,203 B2 * 9/2006 Huffman et al. ..... 239/427
7,185,494 B2 * 3/2007 Ziminsky et al. ..... 60/746
8,074,900 B2 * 12/2011 Brown ..... 239/429

* cited by examiner

*Primary Examiner* — Phutthiwat Wongwian
(74) *Attorney, Agent, or Firm* — Cantor Colburn LLP

(57) ABSTRACT

A dual fuel combustor nozzle includes a body member including a first end portion that extends to a second end portion through an intermediate portion. The intermediate portion includes an outer wall portion and an inner wall portion with the inner wall portion defining a first fuel plenum. The dual fuel nozzle also includes an inner nozzle member arranged within the first fuel plenum. The inner nozzle member includes a first end section that extends to a second end section through an intermediate section. The intermediate section defines a second fuel plenum. The second end section being spaced from the second end portion of the body member so as to define a pre-emergence zone.

14 Claims, 5 Drawing Sheets

DUAL FUEL COMBUSTOR NOZZLE FOR A TURBOMACHINE

BACKGROUND OF THE INVENTION

The subject matter disclosed herein relates to the art of turbomachines and, more particularly, to a dual fuel combustor nozzle for a turbomachine.

The regulatory requirements for low emissions from gas turbine power plants have grown more stringent over the years. Environmental agencies throughout the world are now requiring even lower rates of emissions of NOx and other pollutants from both new and existing gas turbines. Traditional methods of reducing NOx emissions from combustion turbines (water and steam injection) are limited in their ability to reach the extremely low levels required in many localities.

Dry Low NOx (DLN) systems integrate a staged premixed combustion process, gas turbine controls, fuel, and associated systems. Such systems may include two principal measures of performance. The first measure of performance is meeting emission levels required at baseload on both gas and oil fuel, and controlling variations of those levels across the load range of the gas turbine. The second measure of performance is system operability. Design of a DLN combustion system also requires hardware features and operational methods that simultaneously allow an equivalence ratio and a residence time in the flame zone (combustion parameters critical to emission control) to be low enough to achieve low NOx, but with acceptable levels of combustion noise (dynamics), stability at part load operation, and sufficient time for CO burnout.

DLN combustors are in wide use. While effective, DLN combustors were designed mainly for natural gas combustion. New customer demands may require the combustors to have wider fuel flexibility in view of availability of alternative gas fuels and increased cost for natural gas fuel. More specifically, customers may require a combustor capable of running with a blended synthesis gas (syngas) and also capable of running with natural gas alone (dual fuel flexible). Syngas is a mixture of hydrogen and carbon monoxide and sometimes carbon dioxide. Blended syngas may be a mixture of natural gas/hydrogen/carbon monoxide. Syngas is combustible and is often used as a fuel source but has less than half the volumetric energy density of natural gas. As a volumetric flow rate for syngas must be more than double the volumetric flow rate of natural gas for the same combustion flame temperature, syngas fuel pressure ratio will be extremely high (over 1.7) if the same primary nozzle presently used for natural gas fuel is also used for operation with syngas. Such a high fuel pressure ratios may increase system hardware and operational costs.

Existing dual fuel nozzles direct one fuel, through a central nozzle portion and another fuel through an outer conduit portion that extends about the central nozzle portion. Both fuels then emerge from an outlet portion of the nozzle into a combustion chamber, mix, and are ignited. When only one fuel is being utilized, an air purge is required to prevent a back flow of hot combustion products or reactant gases from the combustor into one of the central nozzle portion and outer conduit portion. Typically, when using only one fuel, that fuel is passed though the outer conduit portion and air is passed through the central nozzle portion. The air purge requires additional components and plumbing for the combustor. More specifically, a compressor is required to supply the air for the purge and additional piping and valves are required to switch between the second fuel and the air purge.

BRIEF DESCRIPTION OF THE INVENTION

According to one aspect of an exemplary embodiment, a dual fuel combustor nozzle includes a body member including a first end portion that extends to a second end portion through an intermediate portion. The intermediate portion includes an outer wall portion and an inner wall portion with the inner wall portion defining a first fuel plenum. The dual fuel nozzle also includes an inner nozzle member arranged within the first fuel plenum. The inner nozzle member includes a first end section that extends to a second end section through an intermediate section. The intermediate section includes an outer wall member exposed to the first fuel plenum and an inner wall member. The inner wall member defining a second fuel plenum. The second end section being spaced from the second end portion of the body member so as to define a pre-emergence zone. The pre-emergence zone being configured and disposed to facilitate fuel mixing when at least two fuels are passed through the dual fuel nozzle and to prevent back flow from a combustion chamber when only one fuel is passed through one of the body member and inner nozzle member.

According to another aspect of an exemplary embodiment, a method of injecting multiple fuels from a dual fuel nozzle into a combustion chamber of a turbomachine included passing a first fuel into a first end section of a body member toward a second end section of the body member, passing a second fuel into a first end portion of an inner nozzle member. The inner nozzle member being arranged within the body member. The method also requires discharging the second fuel from a second end portion of the inner nozzle member into the first fuel to form a mixed fuel, guiding the mixed fuel into a pre-emergence zone disposed between the second end portion of the inner nozzle and the second end section of the body member, and discharging the mixed fuel from the dual fuel nozzle into the combustion chamber.

According to yet another aspect of the invention, a turbomachine includes a compressor, a turbine, a combustor operationally linked between the compressor and the turbine. The combustor including a combustion chamber. The turbomachine also includes a dual fuel combustor nozzle mounted to the combustor and fluidly connected to the combustion chamber. The dual fuel nozzle includes a body member includes a first end portion that extends to a second end portion through an intermediate portion. The intermediate portion includes an outer wall portion and an inner wall portion with the inner wall portion defining a first fuel plenum. The dual fuel nozzle also includes an inner nozzle member arranged within the first fuel plenum. The inner nozzle member includes a first end section that extends to a second end section through an intermediate section. The intermediate section includes an outer wall member exposed to the first fuel plenum and an inner wall member. The inner wall member defines a second fuel plenum. The second end section being spaced from the second end portion of the body member so as to define a pre-emergence zone. The pre-emergence zone being configured and disposed to facilitate fuel mixing when at least two fuels are passed through the dual fuel nozzle toward the combustion chamber and to prevent back flow from the combustion chamber when only one fuel is passed through one of the body member and inner nozzle member.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
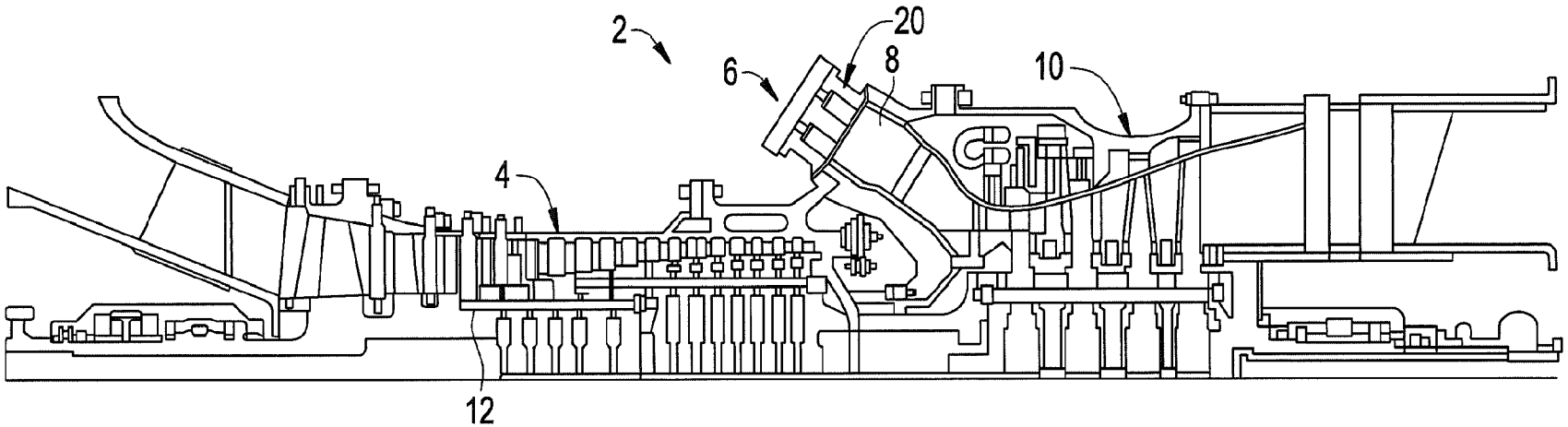
FIG. 1 is a schematic diagram of a turbomachine including a dual fuel combustor nozzle in accordance with an exemplary embodiment.

With reference to FIG. 1, a turbomachine constructed in accordance with an exemplary embodiment is indicated generally at 2. Turbomachine 2 includes a compressor 4 and a plurality of circumferentially spaced combustors, one of which is indicated at 6. Combustor 6 includes a combustion chamber 8 that channels hot gases to a turbine 10 that is operatively coupled to compressor 4 through a common compressor/turbine shaft or rotor 12.

In operation, air flows through compressor 4 such that compressed air is supplied to combustor 6. Fuel is channeled to combustion chamber 8 in which the fuel is mixed with air and ignited. Combustion gases are generated and channeled to turbine 10 wherein gas stream thermal energy is converted to mechanical rotational energy. Turbine 10 is rotatably coupled to, and drives, shaft 12. It should be appreciated that the term "fluid" as used herein includes any medium or material that flows, but not limited to, gas and air. In addition, the term fuel should be understood to include mixtures of fuels, diluents ($N_2$, Steam, $CO_2$, and the like, and/or mixtures of fuels and diluents.

In accordance with an exemplary embodiment, fuel is passed to combustion chamber 8 through a plurality of nozzles one of which is indicated at 20. In further accordance with the exemplary embodiment nozzle 20 constitutes a dual fuel nozzle. More specifically, nozzle 20 injects a first fuel and/or a second fuel, where the two gas fuels may have widely disparate energy content, into combustion chamber 8. In accordance with one aspect of the exemplary embodiment natural gas may be the first fuel and syngas may be the second fuel. Further, syngas fuel may be a 20%/36%/44% combination of natural gas/hydrogen/carbon monoxide (NG/H2/CO).

Figure 2:
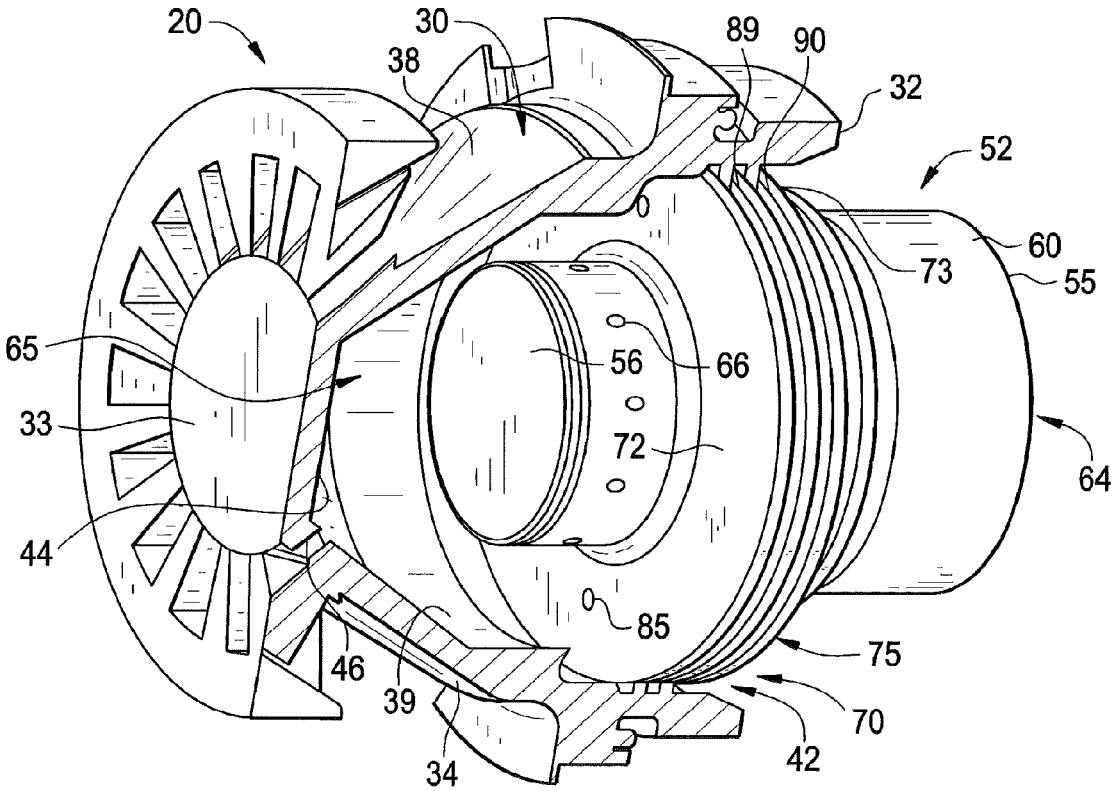
FIG. 2 is a partial cross-sectional perspective view of the dual fuel combustor nozzle in accordance with the exemplary embodiment.
Figure 3:
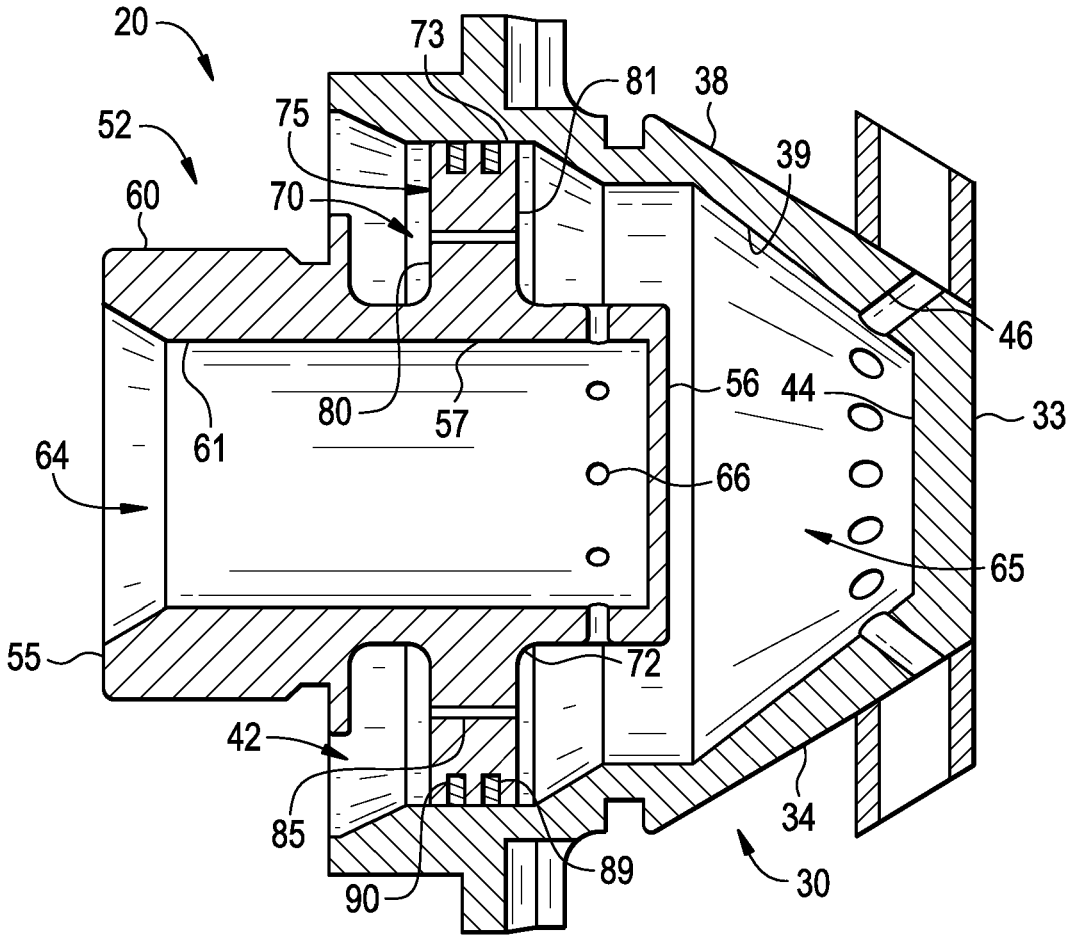
FIG. 3 is a cross-sectional side view of the dual fuel combustor nozzle in accordance with the exemplary embodiment.

As best shown in FIGS. 2 and 3, nozzle 20 includes a body member 30 having a first end portion 32 that extends to a second end portion 33 through an intermediate portion 34. Intermediate portion 34 includes an outer wall portion 38 and an inner wall portion 39 that define a first fuel plenum 42 that extends to an inner surface 44 of second end portion 33. Body member 30 is also shown to include a plurality of outlet members 46 arranged at second end portion 33. As will be discussed more fully below, outlet members 46 direct the first fuel into combustion chamber 8. Often times however the first fuel will be mixed with the second fuel that is also discharged from outlet members 46 in a manner that we will described more fully below.

Nozzle 20 is also shown to include an inner nozzle member 52 having a first end section 55 that extends to a second end section 56 through an intermediate section 57. Intermediate section 57 includes an outer wall member 60 and an inner wall member 61 that defines a second fuel plenum 64. In accordance with the exemplary embodiment, second end section 56 is spaced from second end portion 33 of body member 30 so as to define a pre-emergence zone 65 within first fuel plenum 42. Inner nozzle member 52 is also shown to include a plurality of outlet elements 66 arranged on intermediate section 57 adjacent second end section 56. Outlet elements 66 extend between inner wall member 61 and outer wall member 60 and provide a passage for discharging a second fuel from a second fuel plenum 64 into first fuel plenum 42. More specifically, outlet elements 66 direct the second fuel in a direction that is generally orthogonal, i.e., at about 90°, relative to a longitudinal axis of nozzle 20. That is, the second fuel passes outward from outlet elements 66 towards inner wall portion 39 of body member 30.

In further accordance with the exemplary embodiment, inner nozzle member 52 includes a support flange 70 having a first or inner portion 72 that projects outward from intermediate section 57, towards a second or outer portion 73 defining a body portion 75. As shown, body portion 75 includes a first surface 80 and a second, opposing, surface 81. Body portion 75 is also shown to include a plurality of first fuel orifices, one of which is indicated at 85 that extend between first surface 80 and second surface 81. First fuel orifices 85 provide a pathway for the first fuel passing from first end portion 32 towards second end portion 33 of body member 30. In addition, support flange 70 is shown to include first and second sealing members 89 and 90 that seal an interface region (not separately labeled) between inner nozzle member 52 and body member 30. First and second sealing members 89 and 90 are arranged within grooves (not separately labeled) formed in body portion 75. In accordance with the exemplary embodiment shown, support flange 70 locates inner nozzle member 52 within body member 30. More specifically, support flange 70 co-axially locates inner nozzle 52 within body member 30 such that a longitudinal axis of body member 30 and a longitudinal axis of inner nozzle member 52 are, substantially identical.

With this arrangement, a first fuel enters nozzle 20 at first end portion 32 of body member 30. The first fuel passes into first fuel plenum 42, moves through the plurality of first fuel orifices 85 formed in support flange 70 towards pre-emergence zone 65. A second fuel enters first end section 55 of inner nozzle member 52 into second fuel plenum 64. The second fuel passes along second fuel plenum 64 toward second end section 56 before passing through outlet elements 66. At this point, the second fuel mixes with the first fuel within pre-emergence zone 65 prior to being discharged into combustion chamber 8 through outlet member 46. In this manner, pre-emergence zone 65 provides a mixing region for the first and second fuels. In addition to providing a mixing region, pre-emergence zone 65 serves as a buffer between combustion chamber 8 and first fuel plenum 42. More specifically, in the event that a second fuel is not utilized, the first fuel is simply passed into body member 30, flows through first fuel plenum 42 towards second end portion 33 and is discharged through outlet member 46 and into combustion chamber 8. The flow dynamics of the first fuel discharging through outlet member 46 provides adequate pressure at second end portion 33 of body member 30 to prevent any combustion gases from entering nozzle 20. In this manner, an air purge through inner nozzle member 52 is not required. That is, as second end section 56 is not directly exposed to combustion chamber 8, there is no need to provide an air purge to ensure that combustion gases do not enter into inner nozzle member 52. By doing away with the need for the air purge, other costly components, such as compressors and additional plumbing are no longer required. Thus, the present invention creates a simplified structure for inputting dual fuels into a combustion chamber of a turbomachine while, also allowing a single fuel to be employed without requiring additional costly components to support duel fuel use.

Figure 4:
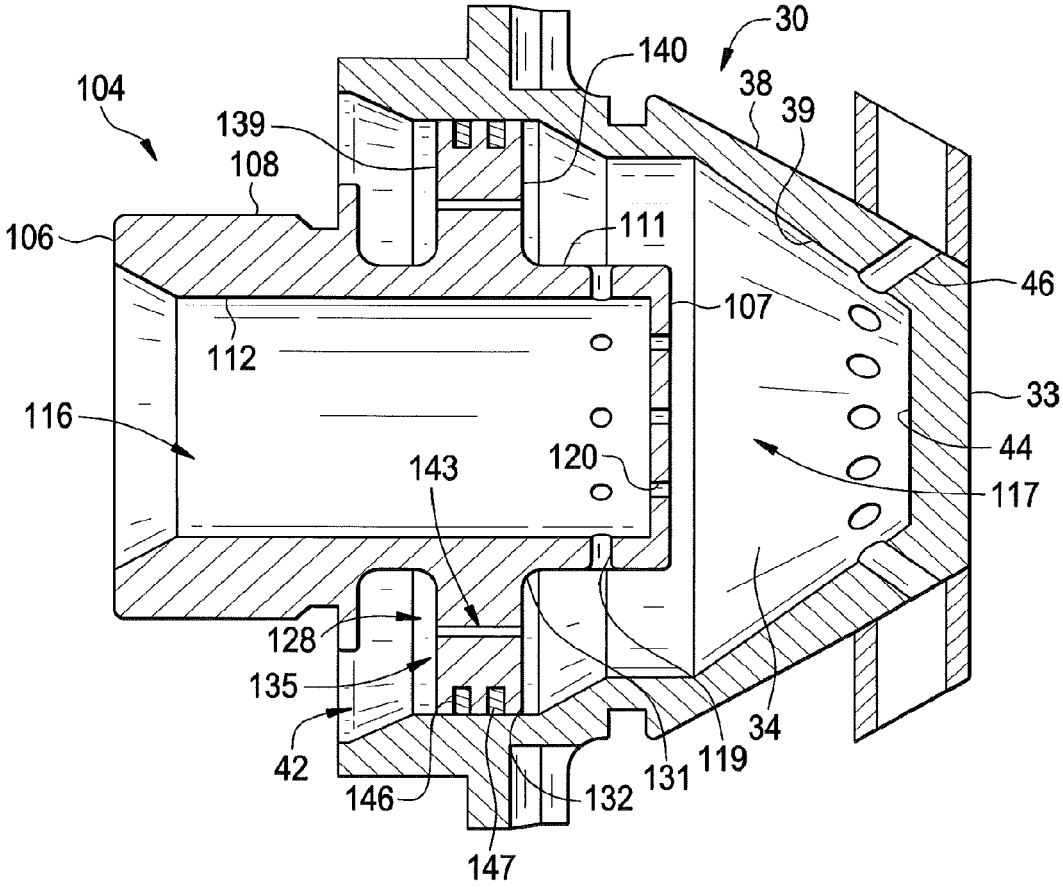
FIG. 4 is a cross-sectional side view of a dual fuel combustor nozzle in accordance with another exemplary embodiment.

Reference will now be made to FIG. 4, wherein like reference numbers refer to corresponding parts in the respective views, in describing an inner nozzle member 104 constructed in accordance with another exemplary embodiment. As shown, inner nozzle member 104 includes a first end section 106 that extends to a second end section 107 through an intermediate section 108. Intermediate section 108 includes an outer wall member 111 and an inner wall member 112 that define a second fuel plenum 116. In a manner similar to that described above, second end section 107 of inner nozzle member 104 is spaced from second end portion 33 of body member 30 so as to define a pre-emergence zone 117. In accordance with the exemplary embodiment shown, inner nozzle member 104 is also shown to include a first plurality of outlet elements 119 that extend between inner and outer wall members 111 and 112 of intermediate section 108 as well as a second plurality of outlet elements 120 shown in the form of openings that extend through second end section 107.

Figure 5:
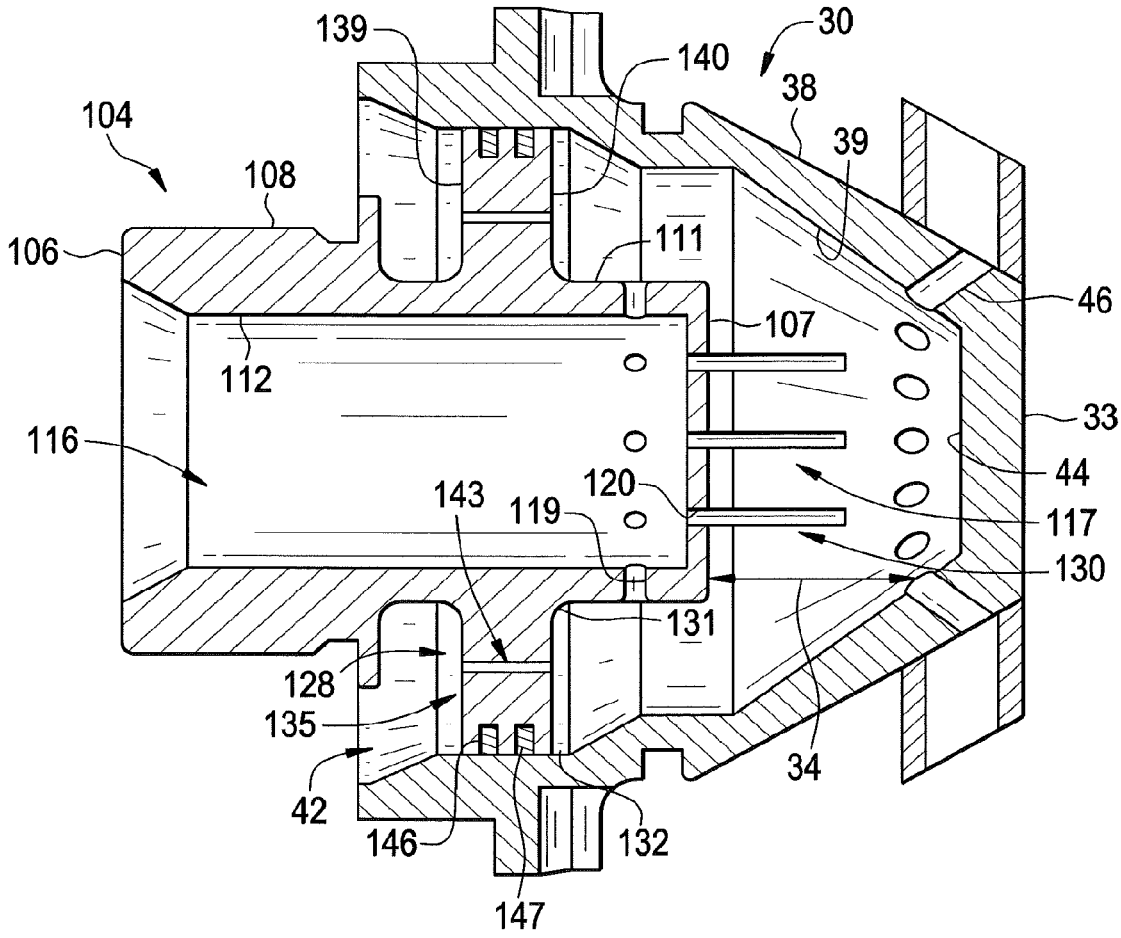
FIG. 5 is a cross-sectional side view of a duel fuel combustor nozzle in accordance with yet another exemplary embodiment.

As best shown in FIG. 5, wherein like reference numbers represent corresponding parts in the respective views, in addition to openings, the second plurality of outlet elements 120 can take the form of tubes 130 that extend from second end section 107 towards inner surface 44 of body member 30. The particular length, diameter of tubes 130 can vary depending upon cooling requirements.

In a manner also similar to that described above, inner nozzle member 104 includes a support flange 128 having a first or inner portion 131 that projects from intermediate section 108 towards an outer portion 132 defining a body portion 135. Body portion 135 includes a first surface 139 and a second, upholding surface 140. Body portion 135 further includes a plurality of first fuel orifices 143 that extend between first and second surfaces 139 and 140. First fuel orifices 143 provide a passage way for a first fuel traveling within first fuel plenum 32 to pass from a first end portion 32 to second end portion 33 of body member 30. Support flange 128 also includes first and second sealing members 146 and 147 that provide a seal between inner nozzle member 104 and inner wall portion 39 of body member 30. Support flange 128 locates inner nozzle member 104 within body member 30. More specifically, support flange 128 co-axially locates inner nozzle 104 within body member 30 such that a longitudinal axis of body member 30 and a longitudinal axis of inner nozzle member 104 are, substantially identical.

In accordance with the exemplary embodiment shown, the second fuel passing through second fuel plenum 116 passes into pre-emergence zone 117 through both the first plurality of outlet elements 119 and the second plurality of outlet elements 120. With this arrangement, the second plurality of outlet elements 120 direct the second fuel onto an inner surface (not separately labeled) of second end portion 33. In this manner, the second fuel provides a cooling effect to a portion of body member 30 exposed to the combustion gases so as to increase an overall service length of nozzle 20 as well as provide various combustion enhancements in turbomachine 2. In any event, the first fuel and second fuel enters pre-emergence zone 117 prior to passing through discharge outlet member 46 into combustion chamber 8. Pre-emergence zone 117 not only provides a pre-mixing for the first and second fuels, but, in a manner similar to that described above, also serves as a buffer between combustion chamber 8 and inner nozzle member 104. That is, in a manner similar to that described above, when only a single fuel is passed through nozzle 20 pre-emergence zone 117 prevents any backflow of combustion gases from combustion chamber 8 into inner nozzle member 104. In this manner, there is no need to provide a constant air purge through inner nozzle member 104. By doing away with the need for the air purge, other costly components, such as compressors and additional plumbing are no longer required. Thus, the present invention creates a simplified structure for inputting dual fuels into a combustion chamber of a turbomachine while, also allowing a single fuel to be employed without requiring additional costly components to support duel fuel use.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A dual fuel combustor nozzle comprising:

a body member including a first end portion that extends to a second end portion through an intermediate portion, the intermediate portion including an outer wall portion and an inner wall portion, the inner wall portion defining a first fuel plenum configured and disposed to direct a first gaseous fuel through the body member; and an inner nozzle member arranged within the first fuel plenum, the inner nozzle member including a first end section that extends to a second end section through an intermediate section, the intermediate section including an outer wall member exposed to the first fuel plenum and an inner wall member, a support flange having first and second surfaces extending from the outer wall member to the inner wall portion includes at least one first fuel orifice, the support flange at least partially defines the first fuel plenum, the inner wall member defining a second fuel plenum configured and disposed to direct a second gaseous fuel through at least one outlet element of the inner nozzle member, the second end section being spaced from the second end portion of the body member so as to define a pre-emergence zone, the pre-emergence zone being configured and disposed to facilitate mixing of the first and second gaseous fuels passing from respective ones of the at least one first fuel orifice and at least one outlet element when at least two gaseous fuels are passed through the dual fuel nozzle and to prevent back flow from a combustion chamber when only one gaseous fuel is passed through one of the body member and inner nozzle member.

2. The dual fuel combustor nozzle according to claim 1, wherein the support flange locates the inner nozzle member within the body member.

3. The dual fuel combustor nozzle according to claim 2, further comprising: at least one sealing member arranged between the support flange and the inner wall portion.

4. The dual fuel combustor nozzle according to claim 2, wherein the support flange locates the inner nozzle member coaxially with the body member.

5. The dual fuel combustor nozzle according to claim 1, wherein the at least one outlet element comprises a plurality of outlet elements arranged on the intermediate section adjacent the second end section, the outlet elements being configured and disposed to direct the second gaseous fuel in a direction orthogonal relative to a longitudinal axis of the duel fuel nozzle toward the inner wall portion of the body member.

6. The dual fuel combustor nozzle according to claim 1, wherein the at least one outlet element comprises a plurality of outlet elements arranged on the second end portion, the plurality of outlet elements being configured and disposed to direct the second gaseous fuel toward the second end portion of the body member.

7. The dual fuel combustor nozzle according to claim 6, wherein the plurality of outlet elements comprises a first plurality of outlet elements arranged on the intermediate portion and a second plurality of outlet elements arranged on the second end portion, the first plurality of outlet elements being configured and disposed to direct the second gaseous fuel from the second fuel plenum in a direction substantially perpendicular to the second plurality of outlet elements.

8. The dual fuel combustor nozzle according to claim 7, wherein the second plurality of outlet elements constitute tubes that extend from the second end portion through the pre-emergence zone.

9. The dual fuel combustor nozzle according to claim 1, wherein the second end portion of the body member includes at least one outlet member.

10. A turbomachine comprising:

a compressor;

a turbine;

a combustor operationally linked between the compressor and the turbine, the combustor including a combustion chamber; and a dual fuel combustor nozzle mounted to the combustor and fluidly connected to the combustion chamber, the dual fuel nozzle including:

a body member including a first end portion that extends to a second end portion through an intermediate portion, the intermediate portion including an outer wall portion and an inner wall portion, the inner wall portion defining a first fuel plenum configured and disposed to direct a first gaseous fuel through the body member; and an inner nozzle member arranged within the first fuel plenum, the inner nozzle member including a first end section that extends to a second end section through an intermediate section, the intermediate section including an outer wall member exposed to the first fuel plenum and an inner wall member, a support flange first and second surfaces extending from the outer wall member to the inner wall portion includes at least one first fuel orifice, the support flange at least partially defines the first fuel plenum, the inner wall member defining a second fuel plenum configured and disposed to direct a second gaseous fuel through at least one outlet element of the inner nozzle member, the second end section being spaced from the second end portion of the body member so as to define a pre-emergence zone, the pre-emergence zone being configured and disposed to facilitate mixing of the first and second gaseous fuels passing from respective ones of the at least one first fuel orifice and at least one outlet element when at least two gaseous fuels are passed through the dual fuel nozzle toward the combustion chamber and to prevent back flow from the combustion chamber when only one gaseous fuel is passed through one of the body member and inner nozzle member.

11. The turbomachine according to claim 10, wherein the support flange locates the inner nozzle member within the body member.

12. The turbomachine according to claim 10, wherein the at least one outlet element comprises a plurality of outlet elements arranged on the intermediate section adjacent the second end section, the outlet elements being configured and disposed to direct the second gaseous fuel in a direction orthogonal relative to a longitudinal axis of the duel fuel nozzle toward the inner wall portion of the body member.

13. The turbomachine according to claim 12, wherein the at least one outlet element comprises another plurality of outlet elements arranged on the second end portion, the another plurality of outlet elements being configured and disposed to direct the second gaseous fuel toward the second end portion of the body member.

14. The turbomachine according to claim 10, wherein the second end portion of the body member includes at least one outlet member.

* * * * *